US007299571B2

(12) United States Patent
Krasner et al.

(10) Patent No.: US 7,299,571 B2
(45) Date of Patent: Nov. 27, 2007

(54) EASE OF IRONING MEASURING APPARATUS AND METHOD

(75) Inventors: Timothy David Krasner, Ossining, NY (US); Jo Anne Tully, Mahopac, NY (US)

(73) Assignee: General Electric Company, Schenectady, NY (US)

( * ) Notice: Subject to any disclaimer, the term of this patent is extended or adjusted under 35 U.S.C. 154(b) by 340 days.

(21) Appl. No.: 11/094,196

(22) Filed: Mar. 31, 2005

(65) Prior Publication Data

US 2006/0225316 A1 Oct. 12, 2006

(51) Int. Cl.
*D06F 77/00* (2006.01)
*D06F 81/00* (2006.01)

(52) U.S. Cl. ..... 38/74; 38/103; 73/9

(58) Field of Classification Search ..... 38/74, 38/75, 76, 79, 96, 97, 99, 103, 104, 137, 38/140; 219/259; 100/92; 223/36; 73/7, 73/9

See application file for complete search history.

(56) References Cited

U.S. PATENT DOCUMENTS

| | | | | | |
|---|---|---|---|---|---|
| 122,680 | A | * | 1/1872 | Thomas | 38/26 |
| 229,758 | A | * | 7/1880 | Socias et al. | 38/30 |
| 1,372,349 | A | * | 3/1921 | Hahn | 38/28 |
| 2,315,474 | A | * | 3/1943 | Wolcott | 248/117.2 |
| 3,975,940 | A | * | 8/1976 | Brungraber | 73/9 |
| 3,976,581 | A | | 8/1976 | Rose | |
| 4,003,241 | A | * | 1/1977 | Thomas | 73/9 |
| 4,130,007 | A | * | 12/1978 | Hayashi | 73/7 |
| 5,074,065 | A | * | 12/1991 | Allenbach | 38/31 |
| 6,116,076 | A | | 9/2000 | Sullilvan et al. | |
| 6,119,505 | A | | 9/2000 | Sullivan et al. | |
| 6,167,745 | B1 | | 1/2001 | Hamer et al. | |
| 6,418,776 | B1 | | 7/2002 | Gitis et al. | |

OTHER PUBLICATIONS

The TMI Group, "Coefficient of Friction Tester" website printout, Feb. 7, 2005.
International Electrochemical (IEC) International Standard 60311, Section 10, Sep. 2002.
Ferret.com website, "'Easy Iron' fabric testing technology", Feb. 15, 2005.

* cited by examiner

*Primary Examiner*—Ismael Izaguirre
(74) *Attorney, Agent, or Firm*—Philip D. Freedman PC; Kenneth S. Wheelock

(57) ABSTRACT

An apparatus to measure ease of ironing comprises a base supporting a vertical rail assembly; a lockable roller bearing block that rolls vertically on a vertical rail assembly for locking and raising and lowering the block at a selected location according to the raising and lowering along the vertical rail assembly. An adjustably inclinable ironing board for accommodating a test cloth is supported at one end by the lockable roller bearing block. The block is raised and lowered along the vertical rail assembly; a standard ironing structure secured overhead to the guide strut and resting at or near the board upper end includes a release mechanism, which releases the iron. The iron moves along the incline and a start sensor and a finish sensor sense the glide of the ironing structure down the board for measuring ease of ironing when the standard ironing board is in an inclined position.

16 Claims, 5 Drawing Sheets

EASE OF IRONING MEASURING APPARATUS AND METHOD

BACKGROUND OF THE INVENTION

The invention relates to an apparatus and method to evaluate ease to iron a fabric or textile.

Ease of ironing is an important claim in fabric care applications. Fabrics and textile treatments that can be incorporated into clothing items that reduce effort in ironing or increase ease of ironing are important. Ease of ironing should not be confused with wrinkle reduction, which may be realized by chemical energy. Ease of ironing is the smoothing of a fabric with a flat object achieved by applying mechanical force to the fabric. Ease of ironing is reduction in the amount of labor or effort to iron.

Consumer care customers use various ease of ironing test protocols to evaluate a reduction in amount of effort involved to iron. Rose, U.S. Pat. No. 3,976,583 relates to a fabric treatment that has a lubricating effect that reduces frictional resistance to the movement of an iron. Thus the effort of ironing garments treated with the Rose compositions is appreciably lessened. The Rose patent further discloses a method and mechanism for determining "ironing ease." In the Rose test method, cotton and polyester/cotton handkerchiefs are washed at 140° F. in a 0.1 percent solution of an anionic detergent-based commercial heavy duty household washing composition ("Cheer"—Procter and Gamble) for 10 minutes, rinsed in water at 105° F. for 10 minutes, spin-dried and tumble-dried at 140° F. for 20 minutes. A 20/1 ratio of water to dry fabric by weight is used in both the wash and rinse. The rinse water for reference fabrics contained no additives other than the 7 gr/gal. hardness present in all wash and rinse solutions. The treatment rinse contained varying amounts of ammonioamidate or a quaternary ammonium compound. Rose then determined "ease of ironing" by a measurement of frictional force within a fabric and between fabric and an iron using a modified Instrom tensile strength apparatus. In Rose, ironing is continued to an end point of removal of wrinkles from the fabrics. The ironing effort tensile strength values relative to water rinsed cotton at a value of 100 and water rinsed polyester/cotton blend at a value of 63 are determined by the Instrom instrument.

The Instrom instrument is designed for a wide variety of uses, only one of which is tensile strength. First, it is questionable whether a tensile reading is relatable to ease of ironing in a real operational environment. Additionally, the Rose methodology to determine "ease of ironing" on this instrument is not always accurate. The methodology to prepare samples and to operate the Instrom instrument is complex and often inaccurate. As such, the Instrom instrument is of little real value for the specific measuring of a fabric's ironing ease.

There is a need for a standardized, simple apparatus and method to quickly measure and compare an ease of ironing metric among test cloths to permit selection of cloth compositions and treatments that provide superior ease of ironing and appearance.

BRIEF DESCRIPTION OF THE INVENTION

The invention provides a standard apparatus and method to quickly evaluate and compare ease of ironing of test cloths.

The apparatus of the invention comprises a base supporting a vertical rail assembly and a framework with a guide strut; a lockable roller bearing block that rolls vertically on the vertical rail assembly for reversibly raising and lowering the block and for locking the block at a selected location according to the raising and lowering along the vertical rail assembly; an adjustably inclinable substantially flat board for accommodating a test cloth and supported at one end, designated the board upper end, by the lockable roller bearing block to support the board in an inclined position as the block is raised and lowered along the vertical rail assembly; a standard ironing structure secured overhead to the guide strut and resting at or near the board upper end; a release mechanism inserted to the guide strut to prevent movement of the standard ironing structure or to release the standard ironing structure to glide down the board when the standard ironing board is in an inclined position; wherein the standard ironing board further comprises a start sensor and a finish sensor to sense glide of the standard ironing structure down the board from the start sensor to the finish sensor when the standard ironing structure is relapsed by the release mechanism when the standard ironing board is in an inclined position.

In an embodiment, the invention is a method to evaluate ease of ironing, comprising: securing a test cloth to a plane inclined at a designated slope; releasing a standard ironing structure to glide down the inclined plane from an upper end to a lower end; sensing a glide time of the standard ironing structure from a set point at or near the board upper end to a set point at or near the board lower end; comparing the glide time of the standard ironing structure on the test cloth with a glide time of another test cloth determined at the same standard ironing structure inclination and same standard ironing structure to determine a comparative ease of ironing metric between the test samples.

DETAILED DESCRIPTION OF THE INVENTION

In this specification, the term "cloth material" is intended to include fabrics, textiles, garments and the like. The terms "ease of ironing" or "improved ironing effort" mean that a cloth material requires less effort to iron. The terms mean that wrinkles can be removed from cloth materials more easily with improved glide of an iron on the materials.

The "ease of ironing" metric determined by the apparatus and method of this invention may be relatable to tribology (the study of interacting moving surfaces, including the study of friction, lubrication, and wear) but is not necessarily limited to determining a tribology metric. The metric of the invention is an easily determined and reproducible metric that can be used to quickly compare ease of ironing of numerous and varying cloth materials. The invention provides a consistently reproducible and straight forward test protocol.

Features of the invention will become apparent from the drawings and following detailed discussion, which by way of example without limitation describe a preferred embodiment of the invention.

Figure 1:
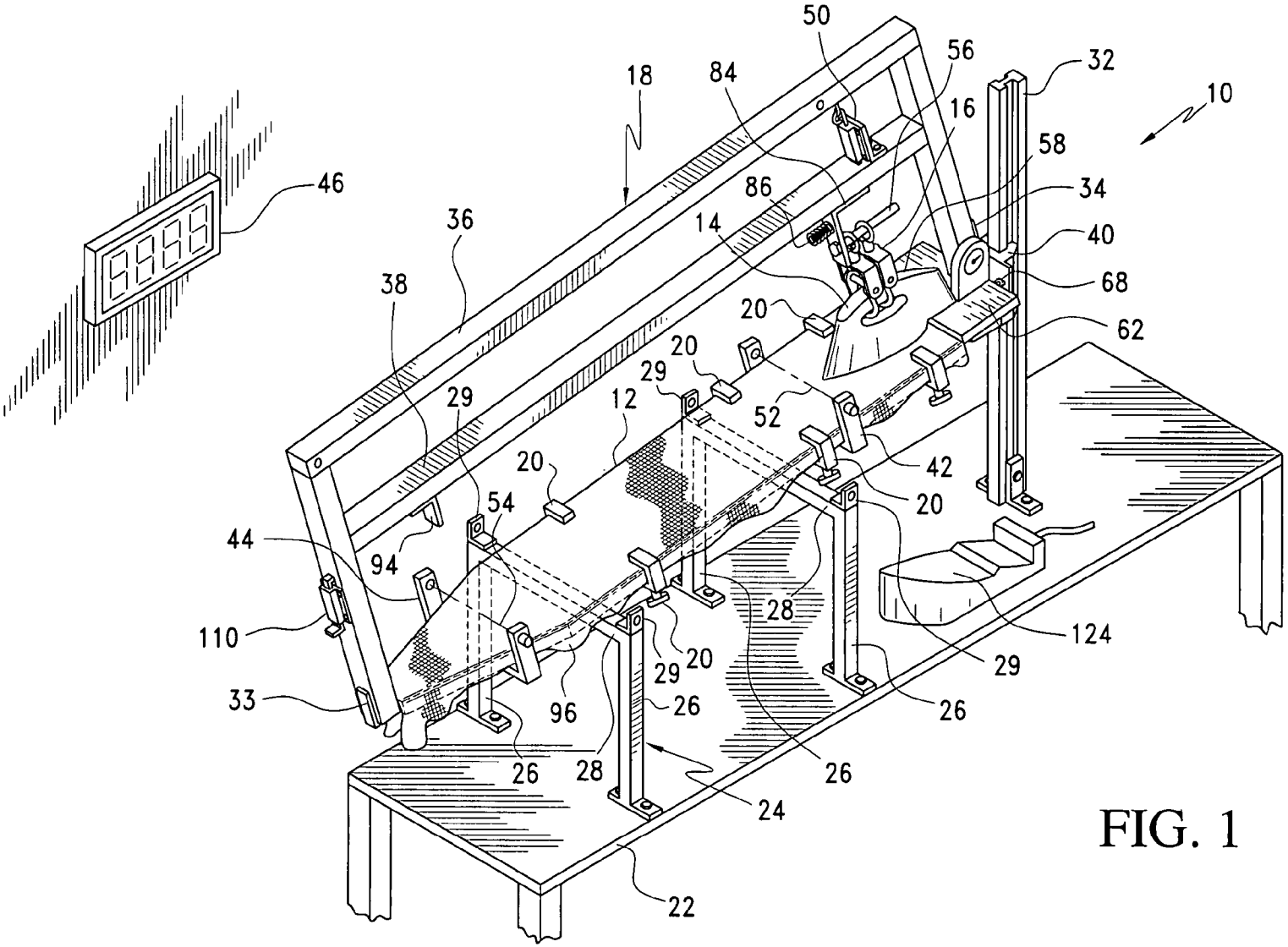
FIG. 1 is a schematic perspective view of an ironing ease measurement apparatus.
Figure 2:
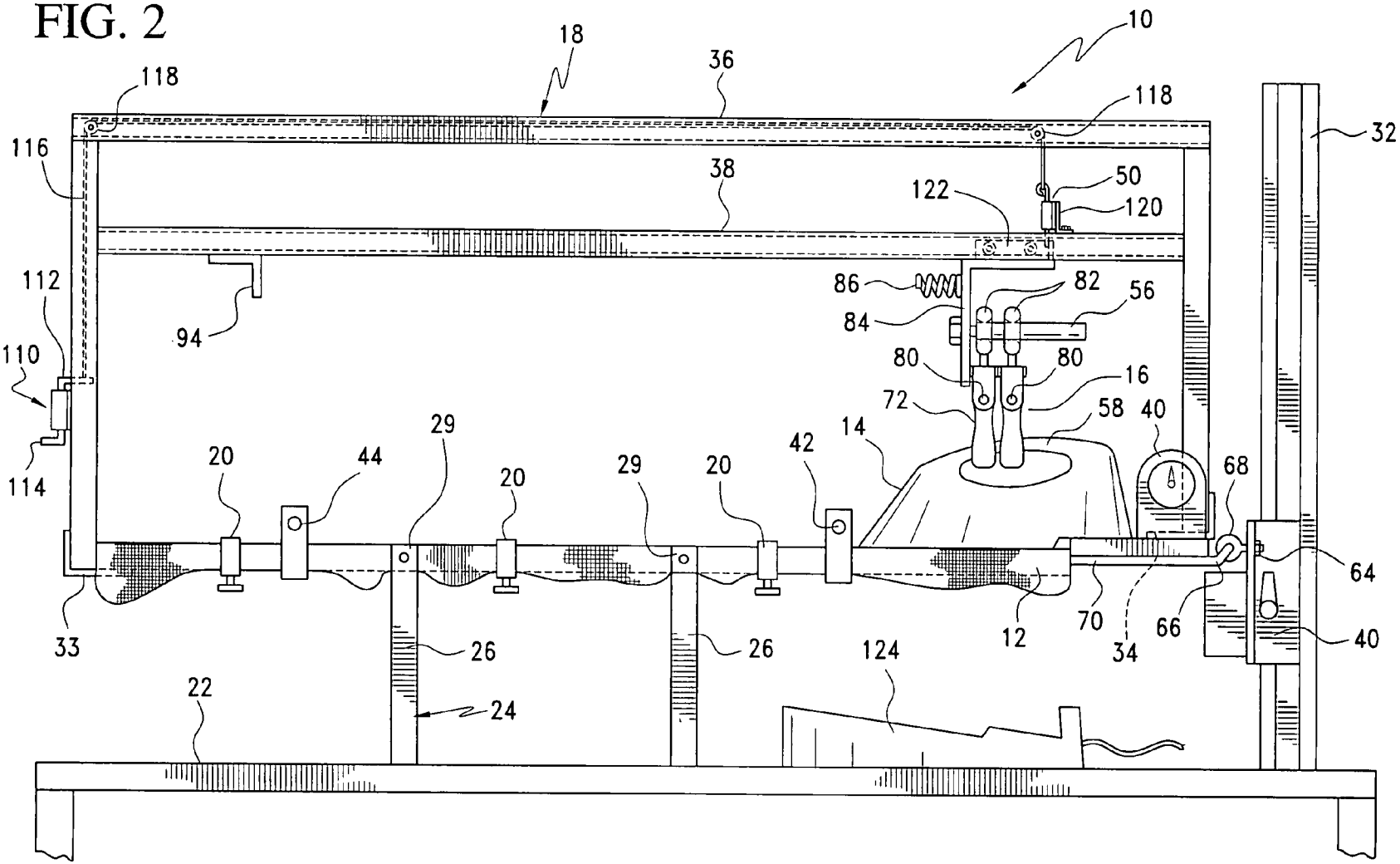
FIG. 2 is a side view of the apparatus of FIG. 1 in a horizontal position and FIG. 3 is a side view of the same apparatus in a raised board position.
Figure 3:
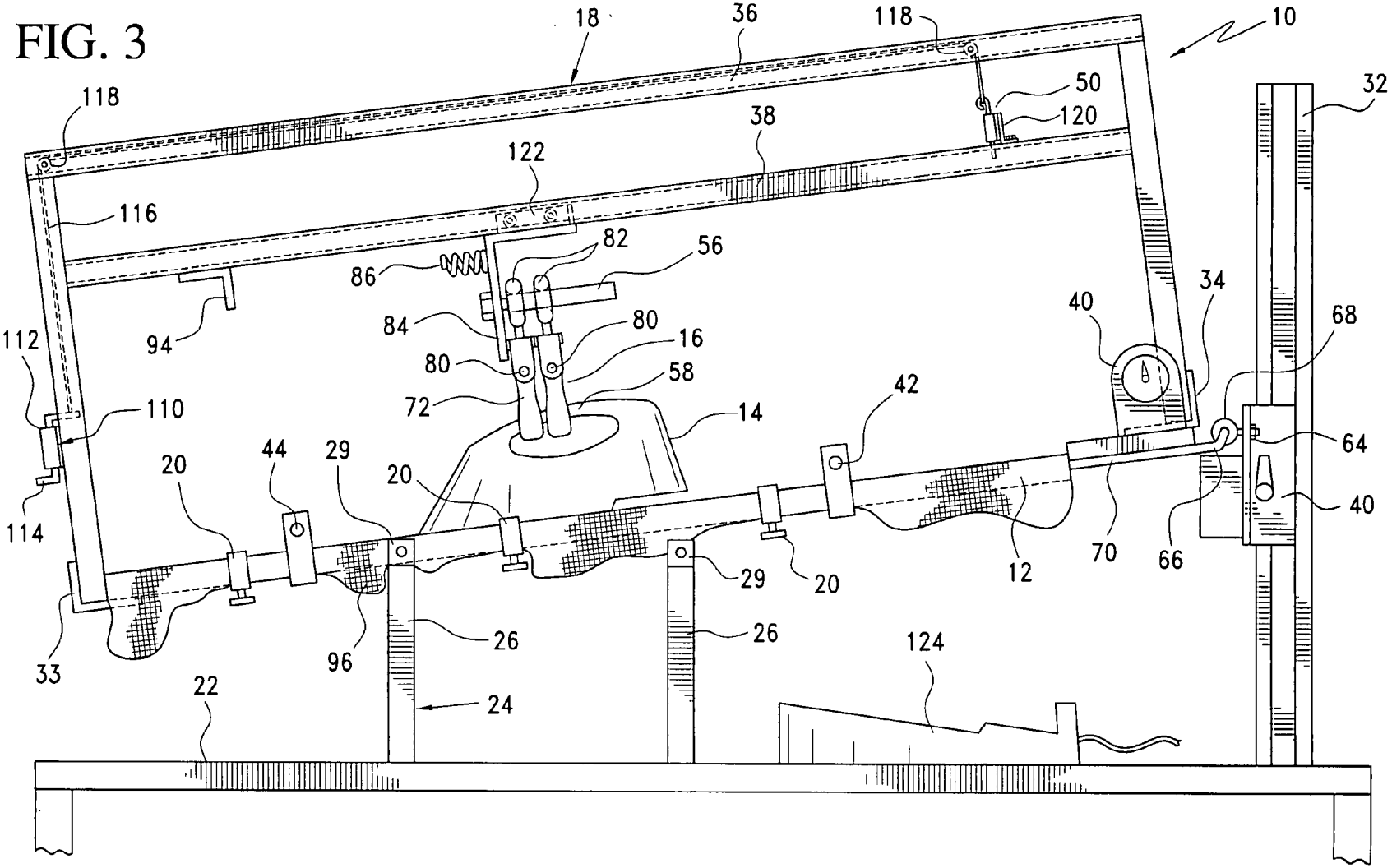
Figure 4:
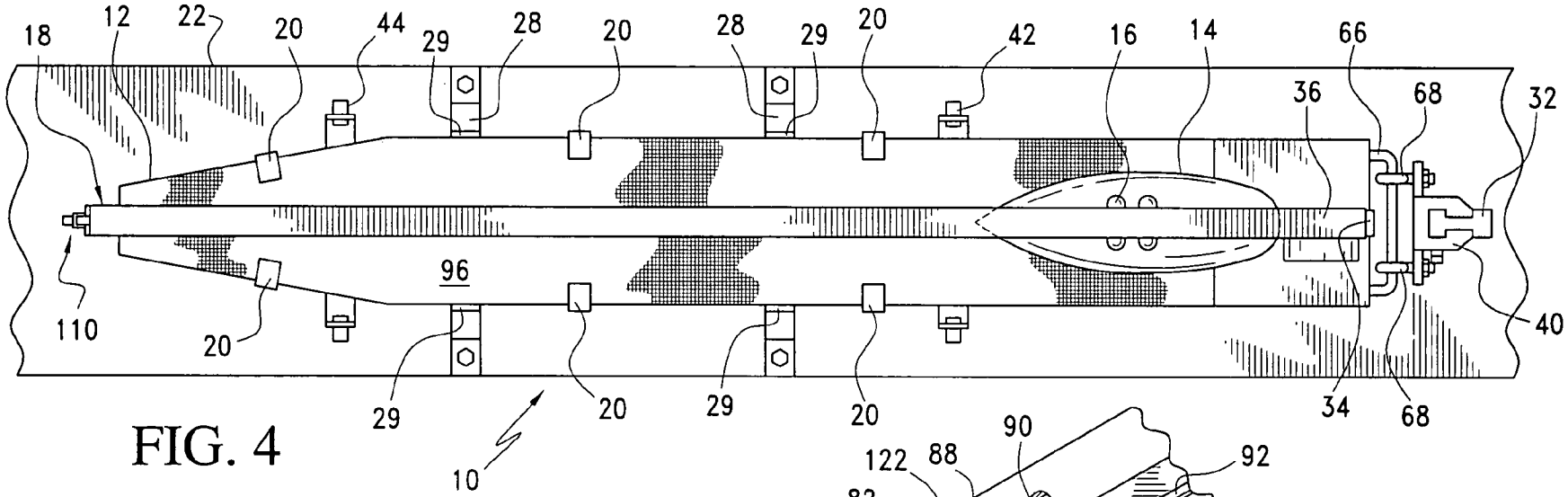
FIG. 4 is a top view of the FIG. 1 apparatus.

Referring to the drawings, FIG. 1 is a schematic perspective view of ironing ease measurement apparatus 1, FIG.; 2 is a side view of the apparatus 10; FIG. 3 is a side view of the same apparatus 10 in a raised board position; and FIG. 4 is a top view of the apparatus 10. The ironing ease measurement apparatus 10 includes ironing board 12, standard iron structure 14, guide trolley 16 and framework 18. Ironing board 12 includes material fasteners 20. The ironing board 12 rests on a support frame 24. Support frame 24 comprises four legs 26 that are secured to base 22 and four rectangularly arranged horizontal beams 28 supported by the legs 26. The ironing board 12 is not secured to the support frame 24 but only rests on the horizontal beams 28. Included with the frame 24, are L-shaped brackets 29, that can extend above of ironing board 12 to prevent lateral board movement.

Framework 18 can be an aluminum strut channel frame comprising a lower clasp with bracket-shape 33 that holds the lower end of the ironing board 12 and an underlying grid support 70 with bar extension 66 that supports board 12 and holds an upper end of the board 12 in a position determined by connection to vertical rail assembly 32. The underlying grid support 70 is pivotally connected by means of the bar extension 66 to eyebolts 68 to a rail assembly 32 that rises vertically from and is supported by the base 22. The pivotal connection comprises lockable roller bearing block 40, which is described more in detail hereinafter. The pivot connection can be raised and lowered up and down the rail assembly 32 and locked into place at a position that defines the incline orientation of the framework 18 and correspondingly that defines an incline of the ironing board 12 held by the bracket 33 and grid support 70.

Further, the framework 18 comprises an upper longitudinal strut 36 that provides stability to the framework and that connects its bracket-shapes 33, 34 to form a detent for the board and a hollow guide strut 38 that runs longitudinally between the bracket-shapes 33, 34, parallel to the upper longitudinal strut 38 to complete the framework 18. The guide strut 38 provides a guide function to the guide trolley 16, which is suspended from the guide strut 38 to operate up and down the length of the guide strut 38 in a direction to the ironing board 12 defined by the guide strut 38. The standard iron structure 14 is controllably connected to the guide trolley 16 in a manner hereinafter described with respect to FIG. 5 so that a glide path of the standard iron structure 14 is determined by orientation of the guide trolley 16, which in turn is determined by operation of the guide trolley 16 along the longitudinal axis of the guide strut 38.

Further, the ironing board 12 of the ironing ease measurement apparatus 10 includes start photoelectric sensor 42 and finish photoelectric sensor 44. Start photoelectric sensor 42 is located near the board 12 end that is closest to the bar extension 66 connection to the rail assembly 32 and the finish photoelectric sensor 44 is located near the opposing end of the board 12. The photosensors are connected to a timing device 46.

FIGS. 1 to 4 show a connection between the board 12 and vertical rail assembly 32 via lockable roller bearing block 40 described as follows: In the FIGs., a frame of C-channels (not shown) supports the board 12 and extends as grid support 70 that supports aluminum plate 62. The grid support 70 has a further bar extension 66 that curves in the shape of a handle outward from one side of the grid support 70 to return to form an opposing side of the grid support 70. Each of a pair of openable eyebolts 68 is held through lockable roller bearing block 40 by a nut 64. The bar extension 66 can be connected through the eyes of the eyebolts 68 to allow inclining and locking of the board 12. This approach allows for multi angle positioning of a secured test cloth so that once the release mechanism 50 is disengaged it will allow discharge of the cordless iron at a measurable optimum angle.

Figure 5:
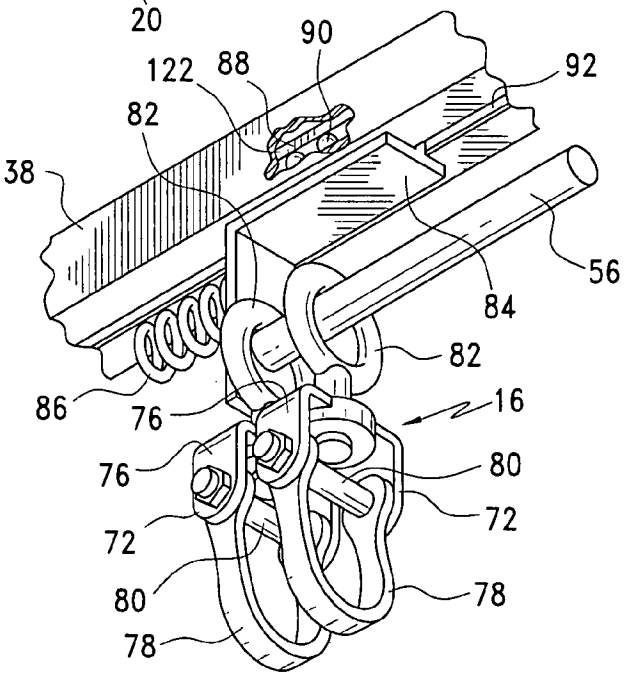
FIG. 5 is a schematic detail of the guide trolley of the FIG. 1 apparatus.

FIG. 5 is a schematic detail of trolley 16 comprising a double clevis hanger 72. Each clevis hanger 72 comprises a yoke 76 and upper U-frame 78. The handle 58 of the iron structure 14 is secured by each yoke 76, each of which is clamped to the upper U-frame 78 by threaded rod 80. Each double clamp structure 72 is slidably slung from smooth bar 56 by an eyebolt 82 that is threaded to a respective U frame 78.

The trolley 16 further comprises a suspension bracket 84 and spring 86. Suspension bracket 84 has an upper riding lip 88 that fits within slot 92 of the hollow guide strut 38. The riding lip 88 encompasses freely rolling ball bearings 90 that permit the trolley to freely traverse down an inclined guide strut 38 in a test run of the invention. The connection of the guide trolley 16 by means of the freely rolling ball bearing 90 and riding lip 88 combination through the slot 92 of guide strut 38 restricts the path of the gliding iron structure 14 to a designated course from the upper end to the lower end of a plane of an inclined board 12. At the same time, free rolling of the bearings 90 permits a glide of the iron structure 14 along the course and on a test cloth 96 secured to the board 12. Spring 86 acts to cushion the iron structure 14 against stop bracket 94 at a conclusion of a test glide.

Figure 6:
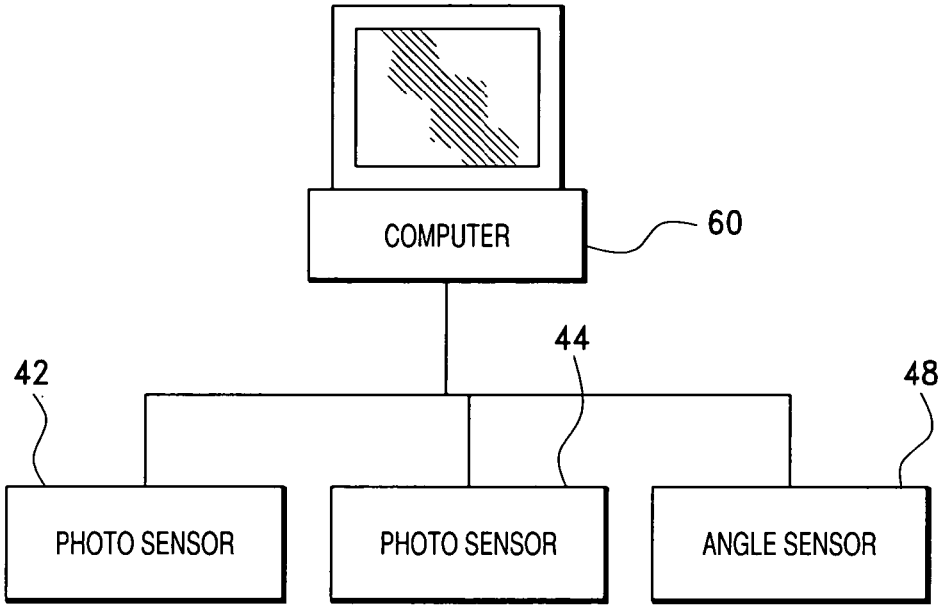
FIG. 6 is a schematic view of parts of the apparatus with a computer.

FIG. 1 shows a timer 46 that registers glide time according to readings of photosensors 42, 44. In another embodiment as depicted schematically in FIG. 6 and as applied hereinafter in the described EXAMPLE, a computer 60, shown in FIG. 6, is used to record results of the apparatus and method and to provide meaningful information concerning ease of ironing. The FIG. 6 system can be part of the apparatus of FIGS. 1 to 5. In the figures, an angle sensor can be set on L-shaped bracket 34, which in turn is supported on plate 62 at a start glide location of the standard iron structure 14. As shown in FIG. 6, the readings of photosensor 42, photosensor 44 and the angle sensor are transmitted to computer 60, where the readings are stored and used to calculate glide times for test cloth ease of ironing comparisons. The computer 60 can include an alterable memory to retain a control program and operation parameters to register and compare glide times. Preferably, the computer 60 is a microprocessor operating under stored program control to record operation of the ironing ease measurement apparatus 10.

To any extent applicable, sample preparation and conditioning and results evaluations can be adapted into this invention from standard testing procedures such as for example, the smoothness evaluation of irons of the International Electrochemical Commission (IEC) International Standard 60311 section 10. As relevant and adopted herein, this standard provides a preparation of test cloths for assessment of smoothing. In operation, a test material is secured to the ironing board 12 by means of the material fasteners 20. Lockable roller bearing block 40 can be run up and down the vertical rail assembly 32 to a desired position. Then, board 12 is inclined by connecting its end to the vertical rail assembly 32 by means of the lockable roller bearing block 40 at an inclined angle that is sensed by an angle sensor 48.

Further, FIGS. 1 to 4 show an activating mechanism 110 that includes a trigger 114 that is spring loaded within housing 112. The trigger 114 is modified to accept an end of timing cable 116, which in turn is connected to release mechanism 50. The timing cable 116 runs over timing pulleys 118 inside of strut channel framework 18 to its connection to the release mechanism 50. Release mechanism 50 is bolted to a modified L shaped bracket 120, which in turn is bolted to framework 18. The release mechanism 50 includes spring latch 122, which restrains roller bearings 90.

In operation, a tester elevates an end of board 12 to a connection with vertical rail 32. Iron 14, which can be first heated in heating dock 124, is placed at a start position. An initial reading of timer 46 and a reading of the angle sensor are recorded. Then, the tester activates trigger 114 downward against the spring bias. Activation of trigger 114 is translated via cable 116 to activate latch 122 of release mechanism 50. Activation of latch 122 releases ball bearings 90 to roll the trolley 16 and correspondingly move the iron 14 down the board 12 incline, guided by guide strut 38. Along its path, the start sensor 42 senses a start time and finish sensor 44 senses a finish time to define an elapsed time. Elapsed times can be determined for the iron 12 on a variety of fabrics or on a fabric with a variety of treatments to provide comparative ease of ironing values.

Standard iron structure 14 can be any structure that can be defined to represent a garment iron such as any electric iron. The standard iron structure 14 usually represents a portable appliance that has an electrically heated sole-plate and that can be used for ironing a textile or fabric. Examples of the irons that can be represented by the standard iron structure 14 include an iron known as a thermostatic iron, which is fitted with a thermostat that can be adjusted to alter sole-plate temperature an electric iron with non-self-resetting thermal cut-out such as a fusible link that disconnects a heating element if the iron attains excessive temperature; a dry iron that has neither means to produce and supply steam nor to spray water onto the textile material; a shot-of-steam iron that is provided with means to supply a shot of steam to textile materials while ironing and that can emit a single emission of an increased volume of steam from a sole-plate for a short duration; a vented steam iron that has an atmospheric pressure reservoir to produce steam when water contacts the sole-plate; a pressurized steam iron that produces steam in a boiler at a pressure exceeding 50 kPa; an instantaneous steam iron that pumps small quantities of water from a water reservoir to produce steam when the water contacts walls of a boiler generator; and a spray iron that can spray water onto the textile materials while ironing to name a few. Standard iron structure 14 is replaceable within the ironing ease measurement apparatus 10 to provide a structure for testing of these various iron structures for ease of ironing of various textile materials. For example, when the ironing ease measurement apparatus 10 is used to evaluate different textile materials, the same standard iron structure can be tested with a variety of textile materials. And, the ironing ease measurement apparatus 10 can be used to evaluate different irons by testing the different iron structures with a standard textile material.

In operation, release mechanism 50 is engaged to prevent rolling of the guide trolley 16 and correspondingly the connected iron structure 14 down the board 12 incline until disengaged. To start a test run, the release mechanism 50 is disengaged to release the guide trolley 16, which by gravity propels the iron 14 down the incline of the ironing board 12. At the commencement of the test run, the start photosensor 42 senses a traverse across a scanned line 52 that transverses a guide path of the standard iron structure 14 to sense passage of the standard iron structure 14 along the path across the line 52 to sense a start and correspondingly the finish. Photosensor 44 senses a traverse across a scanned line 54 that transverses the iron 14 guide path to sense passage of the standard iron structure 14 along the path across the line 54 to sense a finish time. The photosensors 42, 44 are connected to a timer 46 that registers an elapsed time from the start and finish sensed by the photosensors 42, 44.

The test apparatus 10 of the invention provides a mechanism to quickly and reproducibly test cloths for ease of ironing. In operation, board 12 is positioned to a set incline and then the iron 14 is permitted to glide down the inclined board 12 between the start photoelectric sensor 42 and the finish photoelectric sensor 44. A comparison of elapsed time between start and finish of cloth samples provides a measure of relative ease of ironing of the cloth samples.

The following EXAMPLE is illustrative and should not be construed as a limitation on the scope of the claims unless a limitation is specifically recited.

EXAMPLE

In these runs, the test set-up used was the same as depicted in the figures. A commercial grade ironing board was securely mounted in a framework that allowed for multi-inclined positioning. The board was equipped with photoelectric sensors, an electronic timer, and configured with a manual release device. The apparatus configuration included a track roller that allowed a guide trolley to move without restraint. The connected cordless iron then could glide down the board without restraint when released from its starting position.

Silicone chemistries that were thought to be substantive to fabric and exhaustible from dilute aqueous systems were evaluated for ease of ironing after 5× wash/dry cycles. 100% cotton twill and 100% cotton print were washed with a commercial liquid laundry detergent and treated in the rinse cycle with silicone additives, which were post-added to a commercial liquid fabric conditioner at 1 wt %. Silicone A was a pendant polyalkylene oxide modified polydimethylsiloxane. Silicone B was a high molecular weight unmodified silicone fluid, and Silicone C was a cationic amino silicone terpolymer.

The test cloths were tested according to the apparatus and process described in connection with the figures above. Uniformly treated fabric specimens were securely fastened to the inclined ironing board and the times it took for the iron to glide from one sensor to the other were reported in seconds. The values reported are an average of 20 readings. Low numbers are indicative of faster ironing and translate to less work (easier ironing).

Figure 7:
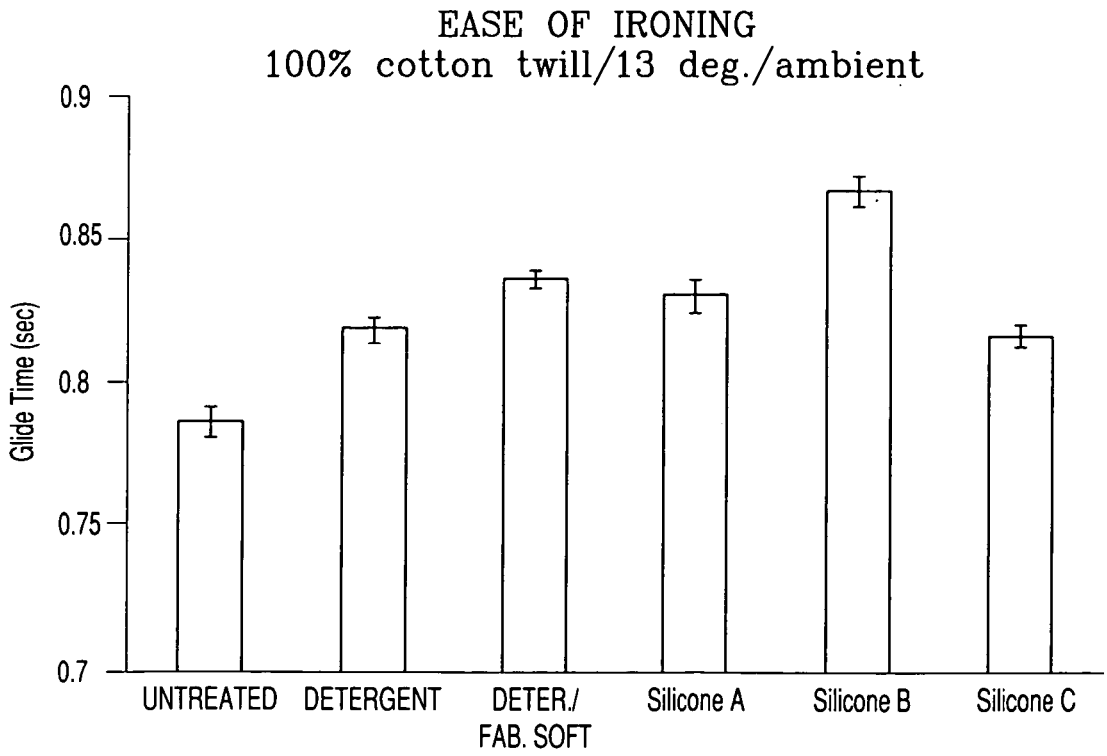
FIG. 7 is a bar graph showing test results.

The FIG. 7 chart demonstrates that the present invention can detect small differences in silicone treatments allowing consumer care companies to make label claims. At the 95% confidence level, most examples in a set of data are close to the average with few extremes. Differences in treatments were statistically different.

While preferred embodiments of the invention have been described, the present invention is capable of variation and modification and therefore should not be limited to the precise details of the Examples. The invention includes changes and alterations that fall within the purview of the following claims.

What is claimed is:

1. An apparatus to evaluate ease of ironing, comprising:

a base supporting a vertical rail assembly and a framework with a guide strut;

a lockable roller bearing block that rolls vertically on the vertical rail assembly for reversibly raising and lowering the block and for locking the block at a selected location according to the raising and lowering along the vertical rail assembly;

an adjustably inclinable substantially flat board for accommodating a test cloth and supported at one end, designated the board upper end, by the lockable roller bearing block to support the board in an inclined position as the block is raised and lowered along the vertical rail assembly;

a standard ironing structure secured overhead to the guide strut and resting at or near the board upper end;

a release mechanism inserted to the guide strut to prevent movement of the standard ironing structure or to release the standard ironing structure to glide down the board when the standard ironing board is in an inclined position;

wherein the standard ironing board further comprises a start sensor and a finish sensor to sense glide of the standard ironing structure down the board from the start sensor to the finish sensor when the standard ironing structure is relapsed by the release mechanism when the standard ironing board is in an inclined position.

2. The apparatus of claim 1, wherein the standard ironing structure is positioned on the board by a trolley suspended by an overhead track so that the iron rests uniformly on the board along a path on the board that is described by the suspension of the trolley by the track.

3. The apparatus of claim 1, wherein the standard ironing structure is positioned on the board by a trolley suspended by an overhead track so that the iron rests uniformly on the board along a path on the board that is described by the suspension of the trolley by the track; wherein the trolley comprises a clevis hanger.

4. The apparatus of claim 1, wherein the standard ironing structure is positioned on the board by a trolley suspended by an overhead track so that the iron rests uniformly on the board along a path on the board that is described by the suspension of the trolley by the track; wherein the trolley comprises a clevis hanger comprising a yoke, an upper U-frame and a threaded rod that clamps the yoke to the U frame.

5. The apparatus of claim 1, wherein the standard ironing structure is positioned on the board by a trolley suspended by an overhead track so that the iron rests uniformly on the board along a path on the board that is described by the suspension of the trolley by the track; wherein the trolley comprises a double clevis hanger.

6. The apparatus of claim 1, wherein the standard ironing structure is positioned on the board by a trolley suspended by an overhead track so that the iron rests uniformly on the board along a path on the board that is described by the suspension of the trolley by the track; wherein the trolley comprises a clevis hanger, slidably slung from the guide strut an eyebolt that is threaded to a U frame of the clevis hanger.

7. The apparatus of claim 1, further comprising a release device located at an adjustable end of the board to releasably secure the standard ironing structure.

8. The apparatus of claim 1, further comprising a timing means for measuring glide time between the first sensor and the second sensor.

9. An apparatus according to claim 1, further comprising a heater for heating the standard ironing structure.

10. The apparatus of claim 1, further comprising a computer for acquiring time readings from the start sensor and finish sensor and to compute a glide time for a test cloth.

11. A method to evaluate ease of ironing, comprising:

securing a test cloth to a plane inclined at a designated slope;

releasing a standard ironing structure to glide down the inclined plane from an upper end to a lower end;

sensing a glide time of the standard ironing structure from a set point at or near the board upper end to a set point at or near the board lower end;

comparing the glide time of the standard ironing structure on the test cloth with a glide time of another test cloth determined at the same standard ironing structure inclination and same standard ironing structure to determine a comparative ease of ironing metric between the test samples.

12. The method of claim 11, further comprising designating the slope to provide an identically comparable incline to tests of a plurality of test clothes and comparing the glide time of the standard ironing structure on a selected test cloth of the plurality with glide times of the remainder of the plurality to determine comparable ease of ironing of the test cloths of the plurality.

13. The method of claim 11, comprising releasing the standard ironing structure to glide down the inclined plane and restricting a path of the gliding structure to a designated course from the upper end to the lower end of the inclined plane.

14. The method of claim 11, comprising releasing the standard ironing structure to glide down the inclined plane and restricting a path of the gliding structure to a designated course from the upper end to the lower end of the inclined plane.

15. The method of claim 11, comprising releasing the standard ironing structure to glide down the inclined plane and restricting a path of the gliding structure to a designated course from the upper end to the lower end of the inclined plane while at the same time permitting a free, uninhibited glide along the course.

16. The method of claim 11, comprising releasing the standard ironing structure to glide down the inclined plane and restricting a path of the gliding structure to a designated course from the upper end to the lower end of the inclined plane while at the same time permitting a free, uninhibited glide along the course by means of a hanging ball bearing connection to a guide strut.

* * * * *